United States Patent [19]

Benscher

[11] 4,274,633

[45] Jun. 23, 1981

[54] INFLATABLE BLADDER AND VALVE

[75] Inventor: Hugo Benscher, Bondi, Australia

[73] Assignee: Benscher & Sons Pty. Limited, Botany, Australia

[21] Appl. No.: 71,151

[22] Filed: Aug. 30, 1979

[30] Foreign Application Priority Data

| | | | |
|---|---|---|---|
| Sep. 8, 1978 | [AU] | Australia | PD5868 |
| Nov. 27, 1978 | [AU] | Australia | PD6936 |
| May 8, 1979 | [AU] | Australia | 46867/79 |

[51] Int. Cl.[3] ..... A63B 41/04

[52] U.S. Cl. ..... 273/65 C; 273/65 A

[58] Field of Search ..... 273/65 D, 65 C, 65 B, 273/65 A, 65 R, 58 R, 58 BA

[56] References Cited

U.S. PATENT DOCUMENTS

| | | | |
|---|---|---|---|
| 1,641,382 | 9/1927 | Goldsmith | 273/65 D |

FOREIGN PATENT DOCUMENTS

| | | | |
|---|---|---|---|
| 633805 | 8/1936 | Fed. Rep. of Germany | 273/65 C |
| 528832 | 11/1940 | United Kingdom | 273/65 D |
| 667027 | 2/1952 | United Kingdom | 273/65 D |

*Primary Examiner*—George J. Marlo

*Attorney, Agent, or Firm*—Dowell & Dowell

[57] ABSTRACT

The combination of an inflatable bladder and valve for inflating the bladder for use with a ball cover and selectively insertable through an opening therein wherein the dimensions of the valve are such as to substantially fill the opening in the ball cover and providing a continuous surface therefor and which valve is maintained in its position within the opening by an outwardly extending flange portion which is urged into contact with the inner surface of the cover by action of the bladder as the bladder is expanded.

1 Claim, 4 Drawing Figures

~PRIOR ART.~

~PRIOR ART~

INFLATABLE BLADDER AND VALVE

The following statement is a full description of this invention, including the best method of performing it known to us:

This invention relates to balls of the type containing an inflatable bladder, and to bladders for such balls.

In order that the external surface of such balls shall be free of any protrusion or irregularity arising from the provision of the bladder inflating valve and the opening required in the cover for access to this valve, it is common practice to provide the cover with an aperture the diameter of which is just sufficient to accept an inflating probe, and otherwise to locate the bladder valve beneath the surrounding portion of the cover. As a consequence, the bladder and valve cannot be inserted into the cover when the cover is complete and fully stitched, but rather the bladder must be placed within the cover prior to the completion of stitching.

Such an arrangement, which is typical of currently manufactured soccer balls, has the serious disadvantage that a faulty bladder can only be replaced by opening part of the stitching of the cover, removing and replacing the bladder, and the re-stitching. This is a lengthy and therefore costly process, and requires an expert stitcher. For this reason it is common practice to discard a soccer ball once the bladder becomes faulty, notwithstanding that the bladder represents only a small portion of the valve of the ball.

The object of the present invention is to provide a construction of bladder valve, and a mode of attachment of the bladder valve within the cover, which enables the bladder to be removed, and a substitute bladder provided, without the necessity of opening the stitching of the cover.

The invention will now be described, by way of example only, with reference to a preferred embodiment thereof.

Figure 1:
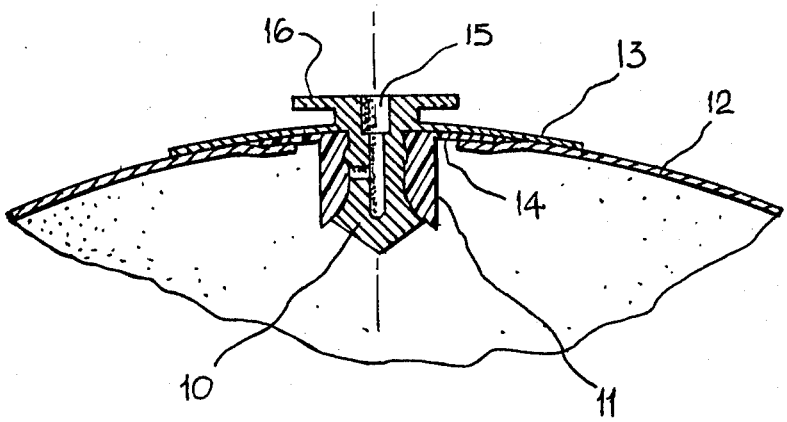
FIG. 1 illustrates in cross-section, a prior art valve and bladder arrangement.

The known valve shown in FIG. 1 consists of a valve body 10 provided with a surrounding closure ring 11, the body and closure ring being attached to a bladder 12 by means of respective flanges 13 and 14. At the upper end of the valve body 10 there is provided a valve probe inlet 15 which is surrounded by a flange 16 the purpose of which is to lie against the inner surface of a ball cover (not shown), the cover being provided with an aperture of a diameter which is approximately that of the valve inflating probe.

Figure 2:
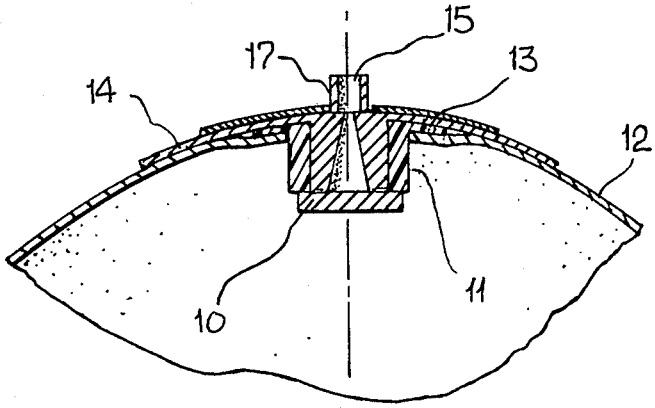
FIG. 2 illustrates in cross-section, a further known valve and bladder arrangement.

FIG. 2 illustrates a somewhat different prior art valve and bladder arrangement. In this case the valve body 10 and a compression ring 11 are again attached to the bladder 12 by flanges 13 and 14, but the valve body terminates at its outer end in a tubular extension 17 which is dimensioned to fit snugly in a small diameter hole in the cover (not shown).

Both the arrangements of FIGS. 1 and 2 suffer from the disadvantage of the prior art discussed above.

Figure 3:
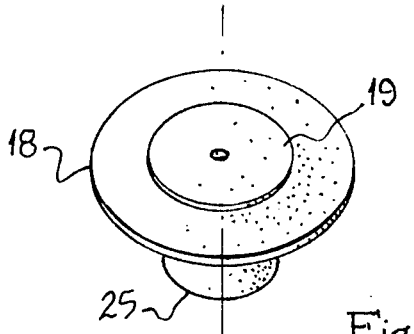
FIG. 3 shows a general isometric view of a valve according to an embodiment of the invention.
Figure 4:
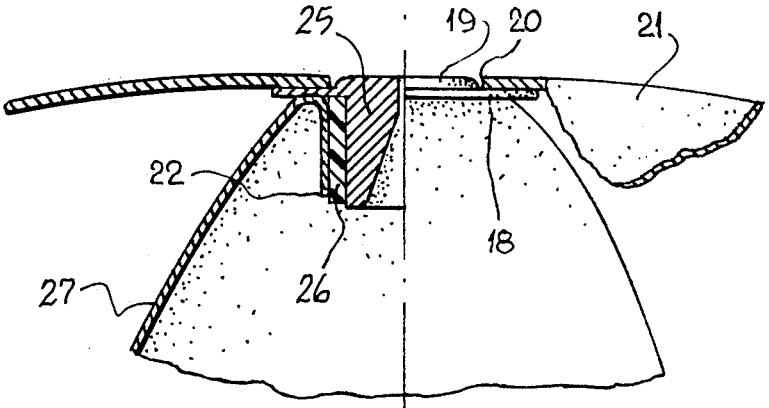
FIG. 4 shows in cross-section, the valve of FIG. 3 located within a ball and attached to a bladder.

As shown in FIGS. 3 and 4, a valve according to the preferred embodiment of the present invention comprises a valve body 25 of elastomeric material, a compression ring (omitted in FIG. 3) 26, surrounding the lower portion of the body 25 below an integral flange 18. The upper portion of the valve body 25, lying above the flange 18, is of such diameter, which in this embodiment is larger than the diameter of the main, lower portion of the valve body 25, as to fit snugly within an aperture 20 in the ball cover 21. The height of the upper portion 19 corresponds to the thickness of the cover 21.

The flange 18 extends to surround the aperture 20, and remains free of the bladder 27, the latter being attached to the valve body and compression ring to which it is fixed in an air-tight manner by adhesive.

The aperture 20 is of such diameter that the bladder 27 with the valve attached to it, may be passed through and in this way the bladder and valve may be provided in a completely sewn cover. The flange 18, which will be pressed against the inner surface of the cover 21 upon inflation of the bladder, may be attached to the cover by adhesive, and the valve is thereby secured in position, with the portion 19 neatly filling the aperture 20 and thereby providing a sufficiently continuous outer ball surface.

When it is desired to remove the bladder after failure thereof, all that need be done is to insert the tip of a sharp cutting instrument, for example a pair of scissors, under the the upper portion or "cork" 19 of the valve body 25, cut around the aperture 20 so as to sever the flange 12 from the valve body 25, withdraw the valve and attached bladder, then insert a means, fingers will do, of breaking the adhesion between the flange 18 and the body of the ball and remove the flange from the ball through the aperture 20.

It will be appreciated that the two great advantages of the present invention are as follows:

(1) The invention allows easy removal from and replacement in the ball of a bladder and valve, without the need for unstitching and re-stitching;

(2) The invention succeeds in providing a valve the top of which lies substantially flush with the outer surface of the ball.

I claim:

1. In the combination of an inflatable bladder and valve for inflating the bladder for use with a ball cover in which the cover is of a predetermined thickness having inner and outer surfaces and an opening of a predetermined size through which the bladder and valve may be selectively inserted when said bladder is in a deflated condition, the improvement comprising said valve means including a valve body having an air passageway for communicating between a valve inlet at one end of the valve body and a valve outlet at the other innermost end of the valve body, said valve having a continuous single flange of flexible material surrounding and extending laterally of said body from a point spaced from the inlet end of said body by a distance substantially equal to the predetermined thickness of the ball cover, said flange being of a dimension to continuously contact the internal surface of the ball cover surrounding the opening therein, said inlet of said valve having lateral dimensions substantially equal to the dimension of the opening in the ball cover, elastic compression ring means surrounding said body of said valve in airtight relationship and extending along a portion of said body between said continuous flange and said outlet end of said valve, said bladder having an opening therein defined by an inverted neck portion, said inverted neck portion surrounding and being attached in airtight relationship along said compression ring means so as to extend between said flange and said outlet of said valve, whereby said continuous flange is urged against the inner surface of said ball cover when said bladder in inflated.

* * * * *